US005867947A

United States Patent [19]

Holtz Hale et al.

[11] Patent Number: 5,867,947

[45] Date of Patent: Feb. 9, 1999

[54] FOLDING PYRAMIDAL STRUCTURE FOR PROTECTION IN CASE OF EARTHQUAKES

[76] Inventors: Ignacio Holtz Hale; Luis Geller Ehrenwald, both of Santa Margarita No. 232, Col. del Valle, 03100, Mexico

[21] Appl. No.: 889,688

[22] Filed: Jul. 8, 1997

[51] Int. Cl.[6] ..... E04B 1/344

[52] U.S. Cl. ..... 52/69; 52/29; 52/167.1; 52/645; 52/652.1; 52/653.1; 52/DIG. 10

[58] Field of Search ..... 52/29, 32, 64, 52/69, 71, 73, 79.4, 125.2, 125.6, 167.1, 167.3, 641, 645, 652.1, 653.1, 573.1, DIG. 10, DIG. 12, DIG. 14

[56] References Cited

U.S. PATENT DOCUMENTS

| | | | |
|---|---|---|---|
| 3,221,464 | 12/1965 | Miller | 52/DIG. 10 |
| 4,170,342 | 10/1979 | Miller et al. | 52/69 X |
| 4,876,830 | 10/1989 | Wate | 52/69 X |
| 5,111,543 | 5/1992 | Epshetsky et al. | 52/167.1 X |
| 5,354,126 | 10/1994 | Pedrego | 52/167.1 X |

FOREIGN PATENT DOCUMENTS

| | | | |
|---|---|---|---|
| 2578281 | 9/1986 | France | 52/DIG. 10 |
| 4061 | 3/1991 | Mexico . | |
| 285490 | 5/1929 | United Kingdom | 52/652.1 |

OTHER PUBLICATIONS

Sherwood, John, "One Answer to Cheap Wine and Lost Lust", The Washington Star, pp. C–1 and C–8, Jul. 1977.

*Primary Examiner*—Carl D. Friedman
*Assistant Examiner*—Laura A. Callo
*Attorney, Agent, or Firm*—Ladas & Parry

[57] ABSTRACT

The invention comprises a folding pyramidal structure in which one or several people can be introduced, being designed to bear extreme loads derived from collapsing of the building provoked by large intensity seismic waves. The particular configuration of the structure allows it to break or deviate structural elements, such as planks, beams and armatures of the collapsing building, falling on it and creating niches, thus allowing its occupants to exit from the enclosure or remaining alive under the rubble, being rescued opportunely. In case of failure of the building during a large intensity earthquake, the niches formed with the help of this structure may avoid death of its occupants.

9 Claims, 10 Drawing Sheets

FOLDING PYRAMIDAL STRUCTURE FOR PROTECTION IN CASE OF EARTHQUAKES

FIELD OF THE INVENTION

The invention relates to earthquake survival equipment and particularly, relates to a folding pyramidal structure designed to bear large loads derived from a building's collapse and to create niches allowing their occupants to exit from the enclosure or to remain alive until being rescued.

BACKGROUND OF THE INVENTION

The closest technical background to the present invention is the rigid pyramidal structure protected in favor of the patentees of the present application, Mexican Industrial Design Reg. No. 4061, dealing with a pyramidal structure for protection in the case of seismic activity. This proposal suitably matches the same purpose for which this invention has been created, that is, to bear structural loads of slabs falling down in a seismic movement and creating niches allowing to preserve the life of the structure's occupants.

Based in tests carried out on the behavior of the Model Registration structure above referred, it has been determined that these matches suitable the demands for the designed purpose. However, its unfolding rigid nature, limits its application by way of losing valuable floor space.

OBJECTS OF THE INVENTION

The main purpose of the present invention is to provide a new version of such a pyramidal structure, including some major improvements, allowing it to be more practical and applicable for its setting even in reduced spaces. The new structure is mainly characterized by being foldable, which allows to keep it in folded or "alert" condition, occupying very little space, and to rapidly deploy to its pyramidal protection form when an earthquake strikes.

DETAILED DESCRIPTION OF THE INVENTION

The pyramidal structure of the present invention, as shown in the attached drawings, comprises a pyramid formed by equilateral triangles with the necessary resistance to bear the weight of the slabs or other structural elements of a building which may collapse during an earthquake.

Inside this pyramid, several persons can be sheltered and because of the design and material from which it is made, is capable to support and deviate great weights avoiding the death by crushing creating niches to save human lives.

Figure 1:
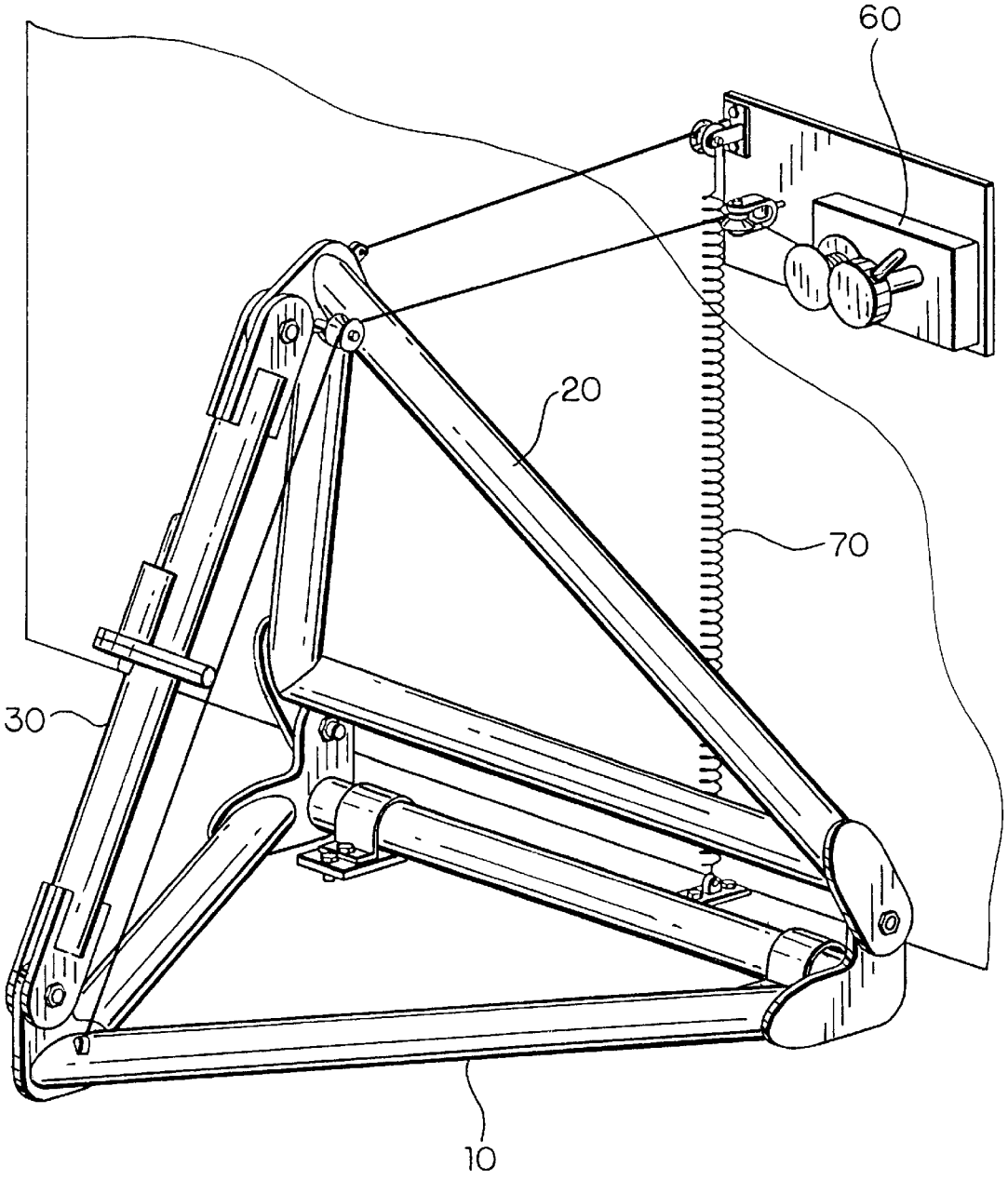
FIG. 1 is a side perspective view of the folding pyramidal structure of this invention.

The pyramid structure is formed by a first triangular member (10) being attached to the floor in a pivotal moving fashion from a horizontal position to an almost vertical position; a second triangular member (20) being connected by hinges (40) with the member (10) in a pivotal moving fashion thereto, from a slanted position towards a essentially vertical position; and a long tubular element (30) being connected by one end (32) with a corner or vertex from the first triangular member (10) and by the other end (34) with a corner or vertex of the tubular member (20). The elements (10,20,30) basically constitute the physical structure of this invention which in a deployment position (FIG. 1) is totally rigid and highly resistant as to bear the loads and impact derived of a building collapse.

In the corners of the triangular members (10,20) are provided some plates (12,22) serving to connect hingedly between them to both members, in a way that this have the relative pivotal movement during deployment and folding of the structure. Also, the triangular members (10,20) have an additional plate (14,24) in which are hingedly connected the ends of the long element (30).

Figure 2:
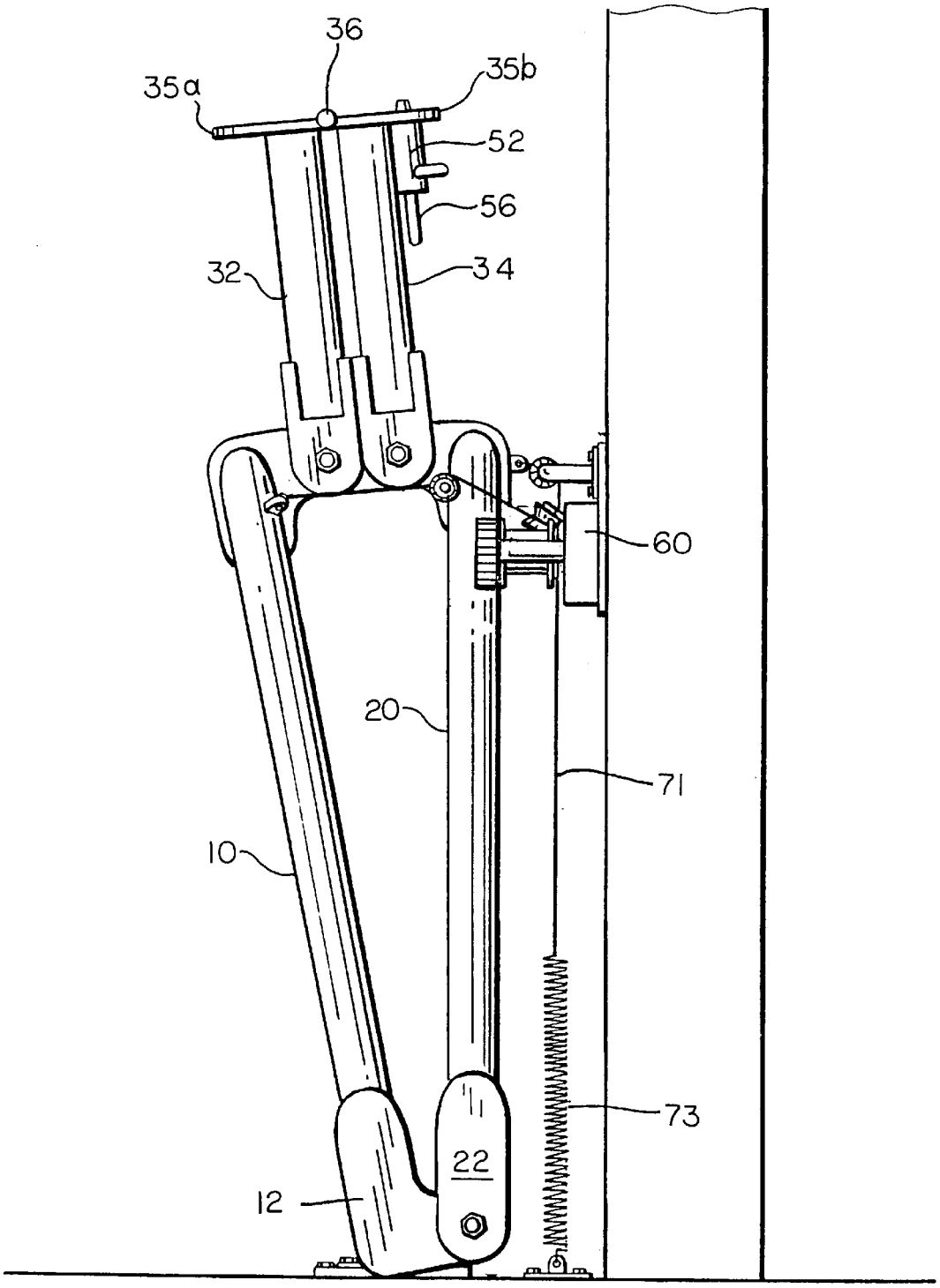
FIG. 2 is a side view of the structure shown in folded condition.
Figure 3:
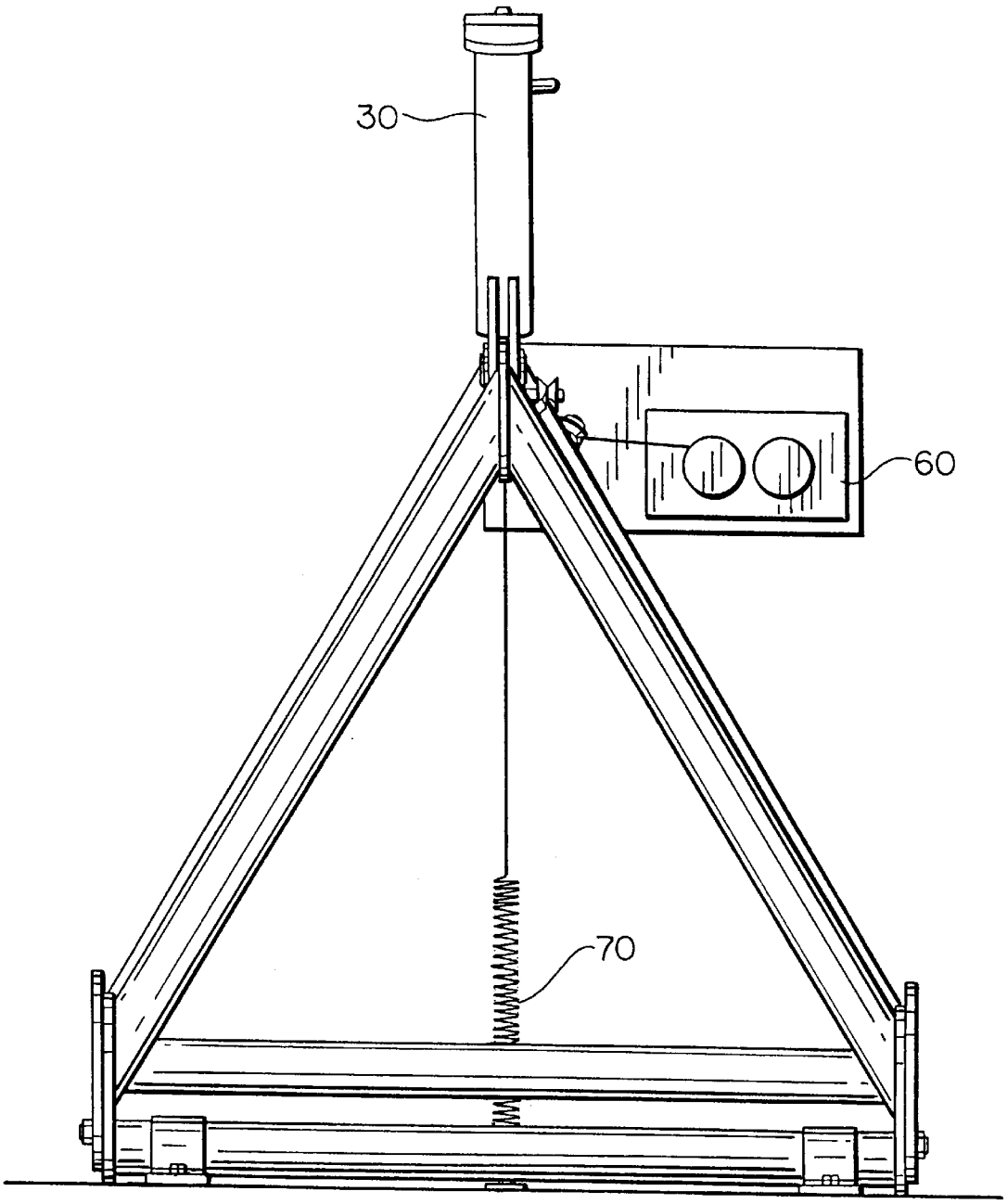
FIG. 3 is a front view of the structure in folded condition.
Figure 4:
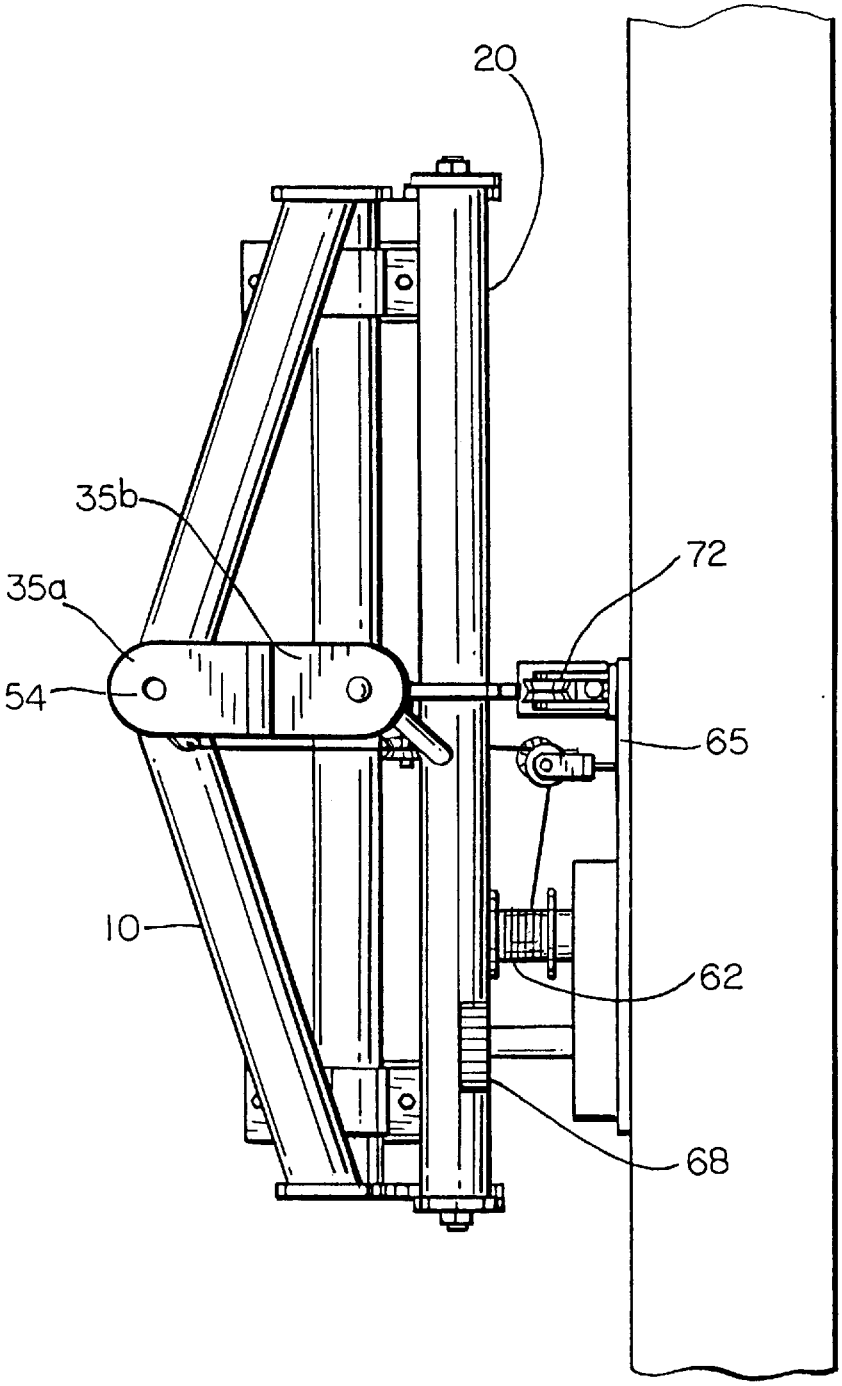
FIG. 4 is a upper view of the folded structure.
Figure 5:
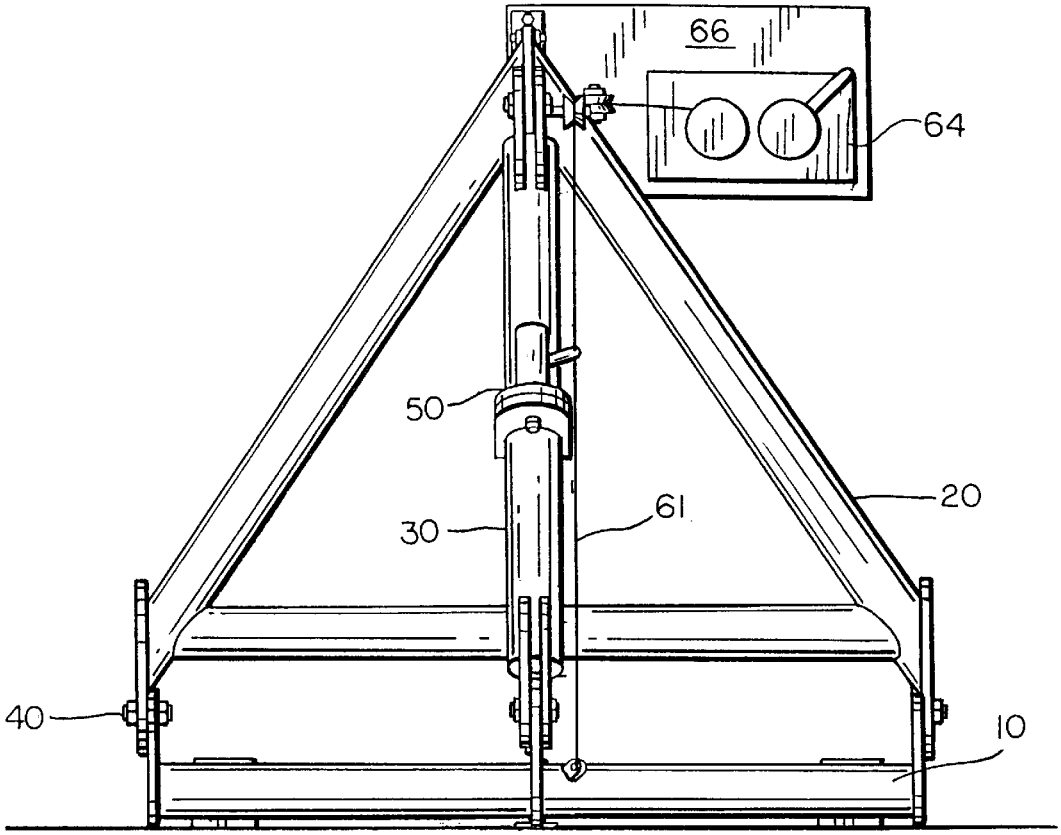
FIG. 5 is a front view of the structure shown in use or unfolded condition.
Figure 6:
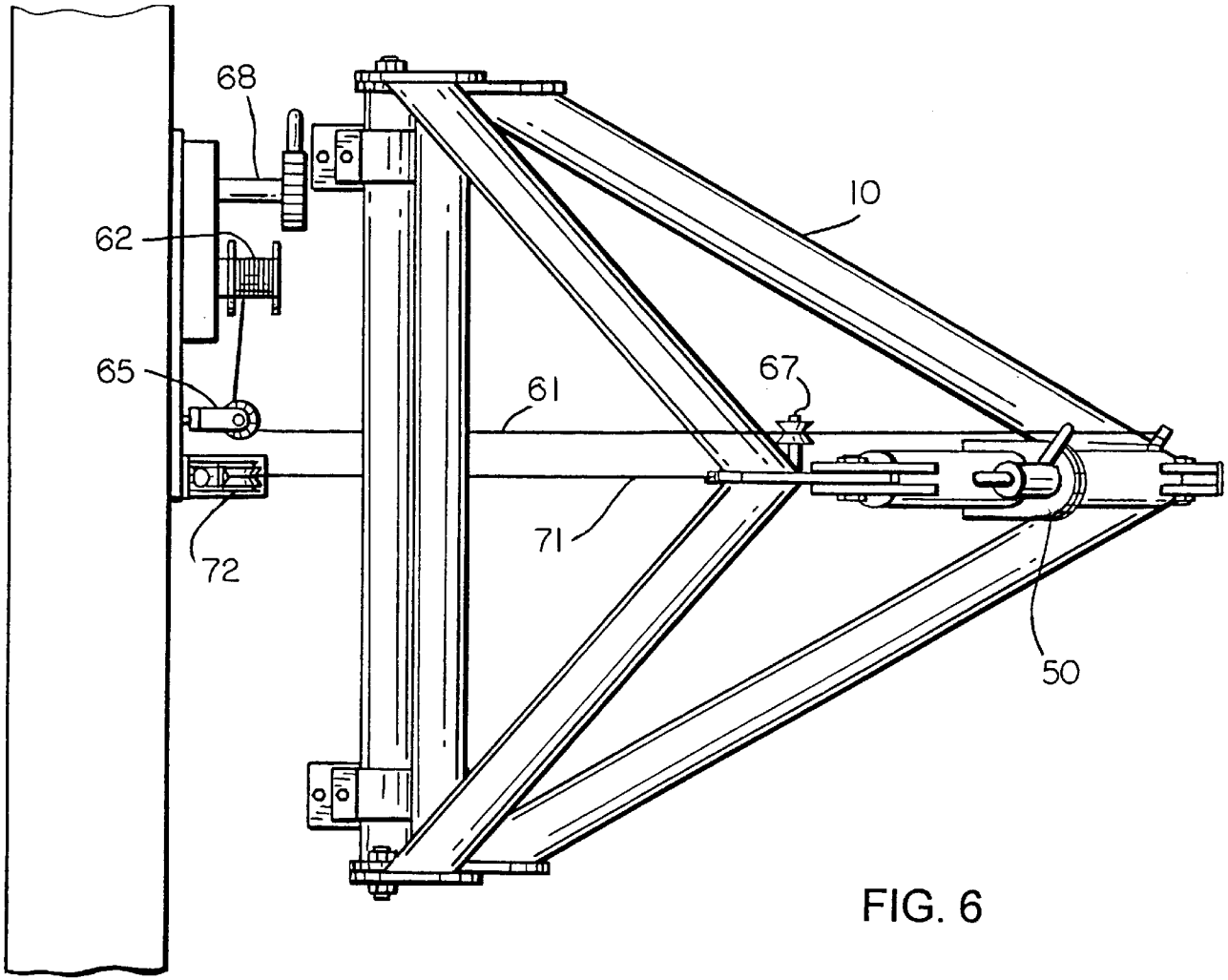
FIG. 6 is a upper view the structure in folded condition.

The element (30) is formed by two parts (32,34) connected between them in the middle by means of hinge element (36), interconnecting some plates **(35*a*,35*b*) fixed to the parts (32,34), respectively, which allows the reciprocating pivotal movement of such parts (32,34) so as to remain collinear when the structure is deployed (FIG. 1) or to remain parallel among them, when the structure is in an alert or folded position (FIG. 2). For the same purpose, the ends of the long element (30) are configured in a way that establishes a hinge part connection with plates (14,24) so that the pieces (32,34)** are moved pivotally for the deployment and folding of the structure.

Figure 7:
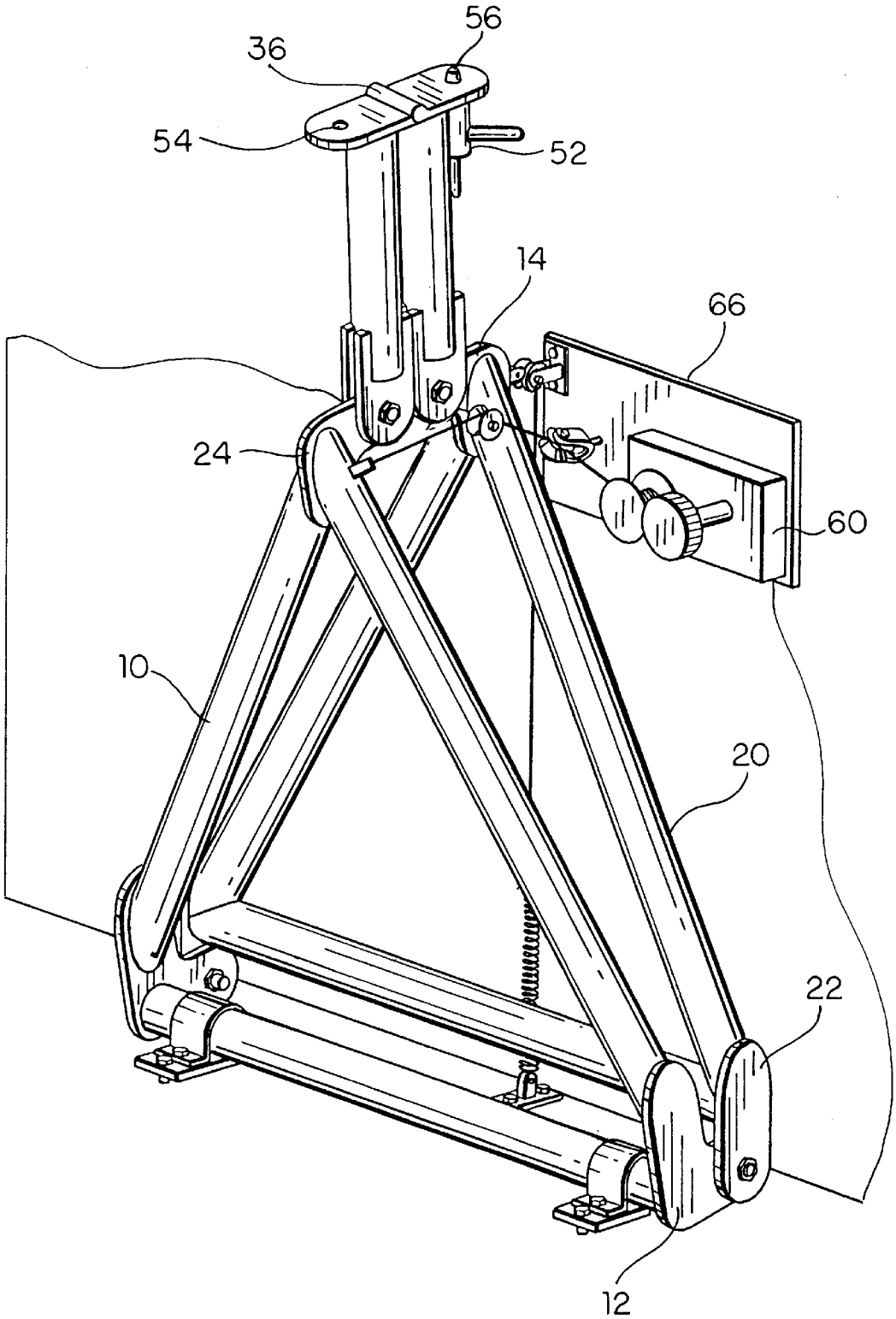
FIG. 7 is a perspective view of the structure in a folded condition.
Figure 8:
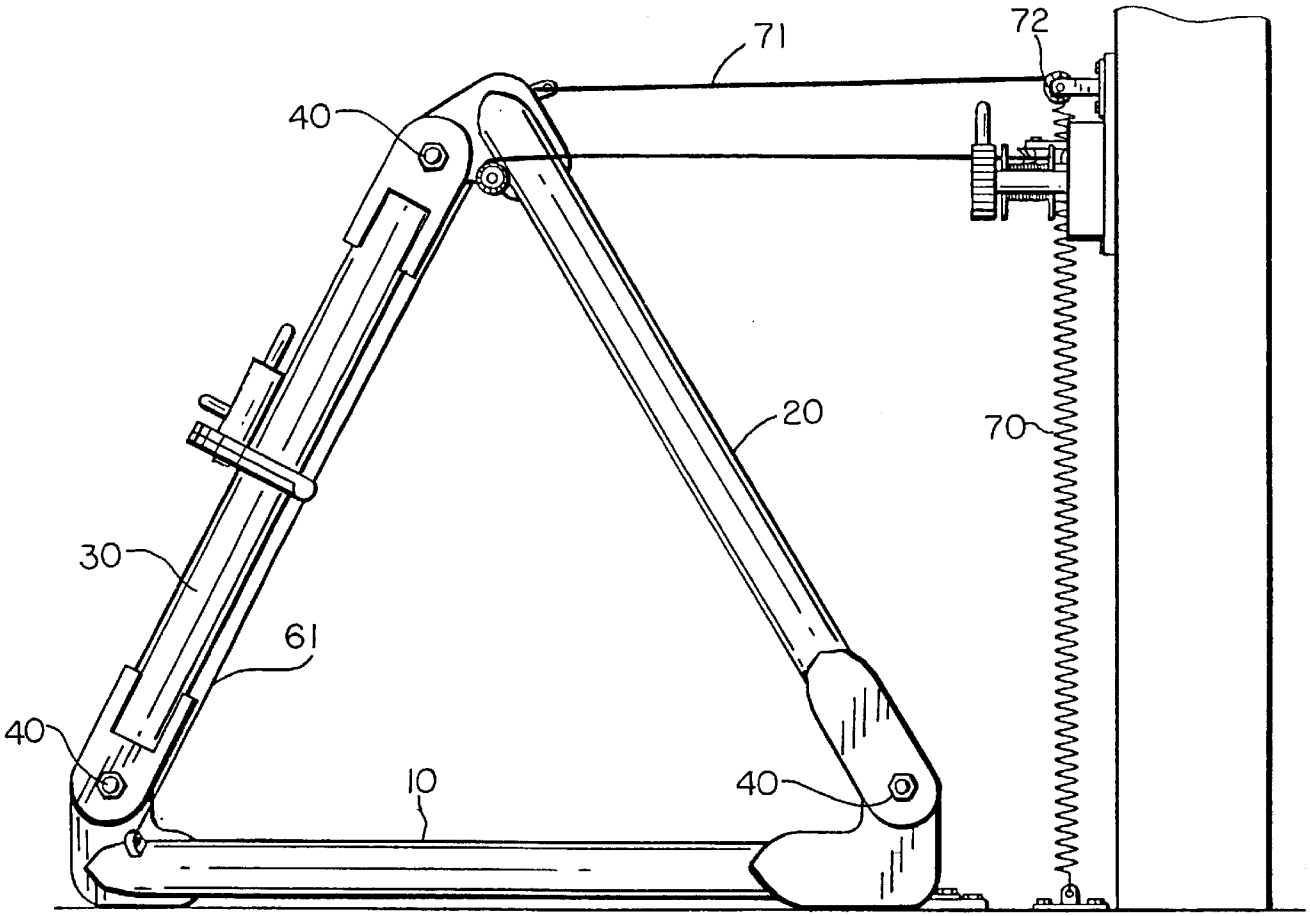
FIG. 8 is a side view of the structure in unfolded condition.

A security mechanism (50) is integrated to the long element (30), which comprises a insert part (52), adhered to the part (34) and resting on the plate **(35*b*), and through the orifice (54) in the plate (35*a*) matching with a pin (56) of the insert piece (52), when the structure is deployed, inserting such pin in the orifice to ensure the suitable rigidity of the long element (30) and thus the pyramidal structure as whole. To fold the structure to its alert position (FIGS. 2 and 7), the pin (56) is withdrawn from the orifice (54) to allow the pivotal reciprocal movement of the pieces (32,34) leading to a parallel position as shown, for example, in FIG. 2**.

The pyramidal structure comprises further a mechanism (60) to deploy to its protection pyramidal shape and fold to its alert position. This mechanism (60) includes means to wind a steel cable (61) in a reel (62), located in a support plate (66) fixed to the wall. An end of the steel cable (61) is locked to the first triangular member (10), in a location near the plate (24), passing through the first universal support type, pulley (65), mounted in the plate (66) and from a second pulley (67) fixed to the plate (14) of the second triangular member (20), or directly thereto.

The pulley (65) is able to pivotally move on its own axes to adapt to the different planes taking the steel cable during the rolling and unrolling thereof in the deployed and folded positions of the structure. The easy and fast deployment and folding of the structure is ensured and further the cable (61) is prevented from tensile stress and cut stress that may affect, at a certain time its suitable operation.

A lever (64) being located also in the support plate (66) serving to activate a brake drum (68) being operatively coupled with the roller means of the cable to control its operation, being to unwind the steel cable from the reel (62) when the structure is deployed or to wind to fold thereof. Also forming part of the mechanism (60) of deployment and folding of the structure there is a tension or stress means comprising a spring (70) anchored to the floor by one of its ends and fixed to the second member (20) of the structure. A spring section (71) is made to pass through the guide pulley (72) firmly fixed to the support plate (66) and changing the direction of said section (71) to a essentially perpendicular plane to the compressible spring section (73).

The purpose of the stress means is to induce the deployment of the structure in a control fashion to avoid the sudden deployment thereof, specially to protect those who might be in the deployment area of such structure, while activating the mechanism (60) to carry the structure to its use position.

Although it is preferred that the deployment mechanism of the structure be manually executed by the user, it will be understood that such action might as well be carried out automatically by means of a seismic sensor which by detecting movement of a certain magnitude automatically will activate the deployment mechanism (60) producing the structure to take its pyramidal shape.

Figure 9:
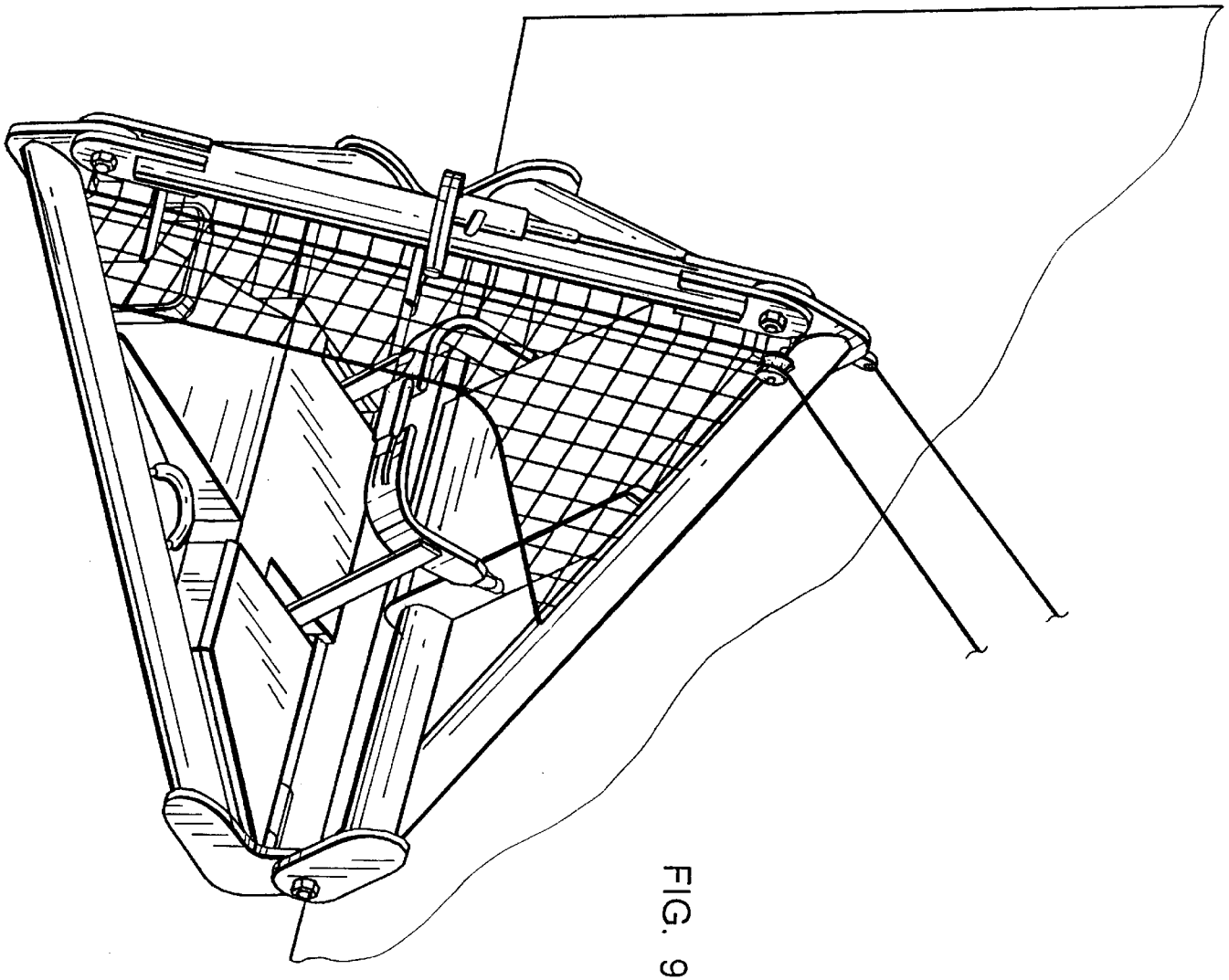
FIG. 9 is a perspective view of the pyramidal structure equipped with additional security elements to protect the physical integrity of its occupants.
Figure 10:
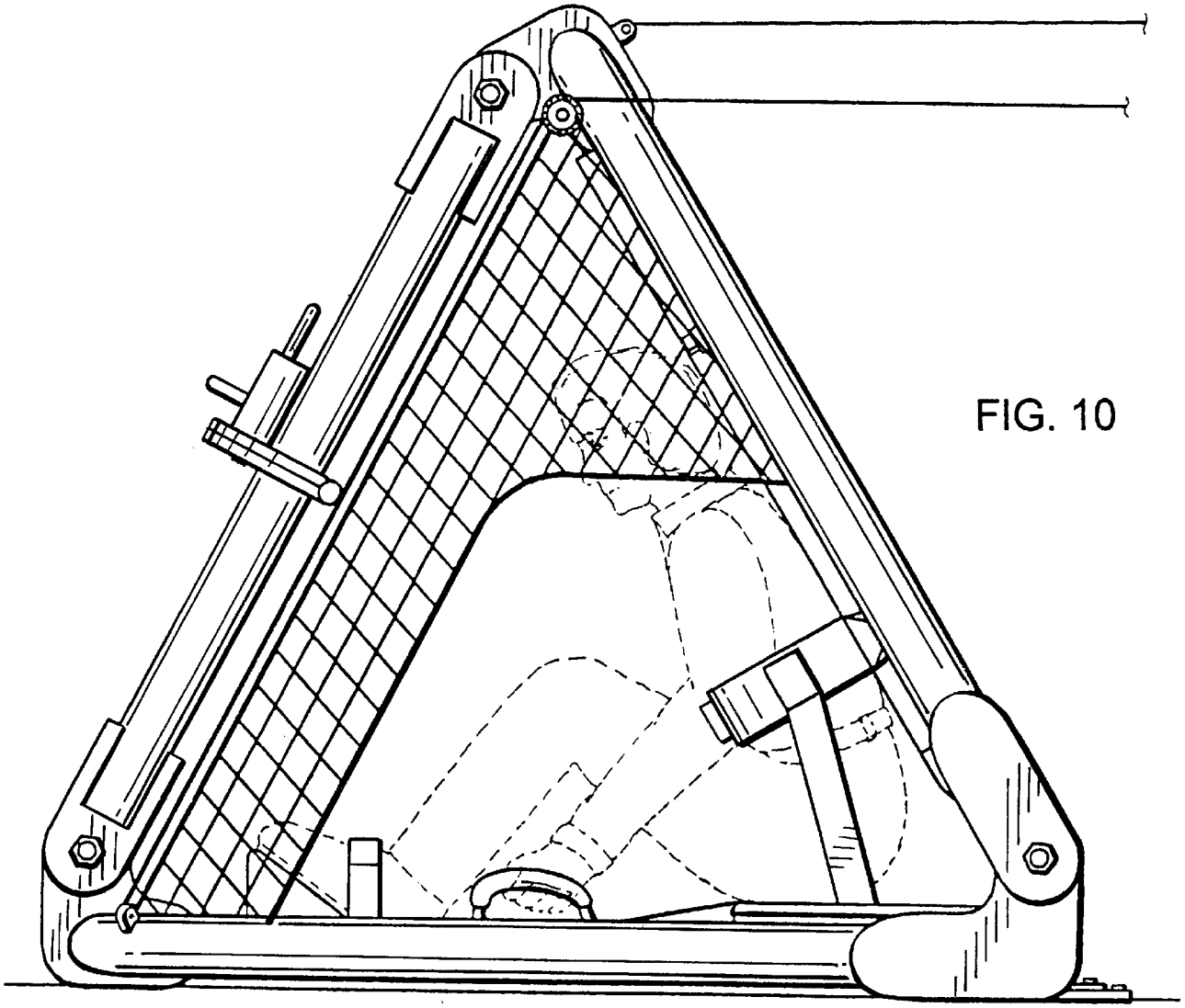
FIG. 10 is a side view of the structure showing inside a person in position.

FIG. 9, shows a deployed pyramidal structure duly equipped with the security elements to safeguard the life of the occupants during an earthquake and its aftermath. As shown, the structure has a security belt, a seat, a protection net for loose elements, supports to hold manually to the structure; and further relevance attachments to be used after the earthquake such as, first aid kit with analgesics, mouth protectors (industrial type), bandages, disinfectants and similar; serum and/or sugary water containers, in amounts enough to last 15 days; containers with nutrients and edible liquids in quantities enough to last 15 days; a small flashlight, an AM-FM radio, a sound signal-generating unit, (manual) AND a "walkie-talkie", provided with long lasting special batteries; an oxygen unit ("Salvo" type); a small sealable compartment for documents, and small objects. These allow the occupants to escape from the pyramidal structure or to signal that they are caught and waiting to be rescued.

The dimensions of the pyramidal structure have been calculated for the type of elements constituting it and allowing inside, up to 4 people, 2 adults and 2 children. This size favors the installation of multiple pyramidal structures in working centers (and similar), it will be understood that its size is not necessary limited to that represented in the attached drawings, since it can be modified to widening the operating capacity in certain specific needs.

In case of a major earthquake, the people may locate the nearest pyramidal structure, enter, put on the security outfit and hold to the support bar. In case the building collapses, occupants of the structure may escape by the niches being formed by falling debris or wait to be rescued. If an earthquake strikes, and the building does not collapse, its occupants may exit the structure calmly and, by means of the lever, retract such structure to its alert folded position.

It must be pointed out that the best method to carry into practice this invention is that which is clearly inferred from the detailed description.

We claim:

1. A folding pyramidal structure to protect in case of an earthquake, designed to bear extreme loads derived from collapsing of a building or edification, provoked by large intensity seismic waves; the structure being characterized by comprising:

a first rigid member essentially triangular, being attached to a floor in a hinged way to move pivotally, from a horizontal deployed position to a folded alert position having an angle under 90° with respect to the horizontal plane;

a second rigid member essentially triangular hingedly connected with the first triangular member, to pivotally move from an inclined deployed position towards a vertical folded alert position;

a long element being connected, hingedly, by one end with a vertex of the first triangular member and by the other end with a vertex of the second triangular member to form as a whole the pyramidal structure; and a mechanism to deploy the structure to the protecting pyramidal structure shape and to fold it to the alert position.

2. The folding pyramidal structure according to claim 1, characterized in that the first and second triangular members have plates at their corners to establish the hinged connection between both triangular members and with the long element.

3. The folding pyramidal structure according to claim 1, characterized in that the long element is formed by two sections with a hinged connection therebetween, to remain collinear when the structure is deployed to the pyramidal structure shape and essentially parallel when the structure is folded in the alert position.

4. The folding pyramidal structure according to claim 3, characterized in that a security mechanism in the long element is adapted to keep the two sections collinear and rigid when the structure is deployed.

5. The folding pyramidal structure according to claim 1, characterized in that the deploy and fold mechanism of the structure comprises:

steel cable, winding means, and a wind reel for the cable, the winding means and the wind reel located in a fixed support plate to a wall near the structure, wherein an end of the steel cable is locked to a first attachment member of the first triangular member;

first and second pulleys to guide the steel cable during deployment and folding of the structure, the first pulley being located on the support plate and the second pulley being subject to the second triangular member; and a drum brake lever, located in the support plate, being operatively connected with the winding means to control the activation of said winding mean.

6. The folding pyramidal structure according to claim 5, characterized in that the first pulley is universal so that it can be pivotally moved for a suitable sliding of the steel cable during the deployment and folding of the structure.

7. The folding pyramidal structure according to claim 1, characterized in that the deployment and folding mechanism of the structure includes also stress means to control the speed of deployment of the structure.

8. The folding pyramidal structure according to claim 7, characterized in that the stress means comprises a spring anchored to the floor by one of its ends and by the other end locked to the second triangular member; a section of said spring passes through a guiding pulley locking to the support plate.

9. The folding pyramidal structure according to claim 1, characterized by being provided with means to safeguard the life of occupants during the earthquake and after it, specially useful in case of collapsing of the building.

* * * * *